United States Patent [19]
Damm et al.
[11] 4,148,343
[45] Apr. 10, 1979

[54] BLOW PLATE AND BLOW TUBE ASSEMBLY

[75] Inventors: Thomas A. Damm, Muskegon; Robert C. Damm, Whitehall, both of Mich.

[73] Assignee: Pyle Pattern & Maf. Co., Muskegon Heights, Mich.

[21] Appl. No.: 806,772

[22] Filed: Jun. 15, 1977

[51] Int. Cl.[2] ..... F16L 9/12
[52] U.S. Cl. ..... 138/178; 138/103; 138/177; 138/DIG. 11; 164/200
[58] Field of Search ..... 164/200; 285/355, 332.3, 285/390, 3, 4; 403/306, 390, 296; 138/178, 96 R, 103, 177, DIG. 11

[56] References Cited

U.S. PATENT DOCUMENTS

| | | | |
|---|---|---|---|
| 70,712 | 8/1902 | Nethery | 138/104 X |
| 1,305,007 | 5/1919 | Robertson | 285/355 X |
| 1,364,478 | 1/1921 | Boyd et al. | 285/390 X |
| 2,449,754 | 9/1948 | Seitz | 138/178 X |
| 3,214,198 | 10/1965 | Peuchmaur | 285/355 X |
| 3,460,607 | 8/1969 | Olson | 164/200 |

FOREIGN PATENT DOCUMENTS

| | | | |
|---|---|---|---|
| 446021 | 1/1948 | Canada | 285/355 |
| 744307 | 10/1966 | Canada | 164/200 |
| 256356 | 2/1913 | Fed. Rep. of Germany | 164/200 |

*Primary Examiner*—Richard B. Lazarus
*Attorney, Agent, or Firm*—McGlynn and Milton

[57] ABSTRACT

A blow plate and blow tube assembly. The blow tube conveys core-making sand from the blow plate to a cavity in a core box for forming a sand core utilized in metal casting. The blow plate has a discharge passage with female threads. The blow tube has a body portion and a tip portion for directing the sand from the blow plate into the core box. The body portion of the blow tube has male threads axially therealong and the blow tube is threaded into the passage in the blow plate and extends from the blow plate for engaging the core box. A nut is threaded onto the male threads of the body portion of the blow tube and is disposed between the blow plate and the core box. The blow tube is made of plastic material and includes a shoulder or sleeve portion between the male threads on the body portion and the conically-shaped tip portion. The conically-shaped tip portion has spaced annular ribs thereabout for forming seals with a conical seat in the core box. The plastic of the blow tube may be cut or severed to provide a blow tube of various different lengths depending upon the blow plate and core box configuration. The wall thickness in the tip portion of the blow tube increases from the tip toward the body portion.

5 Claims, 2 Drawing Figures

BLOW PLATE AND BLOW TUBE ASSEMBLY

BACKGROUND OF THE INVENTION (1) Field of Invention

The subject invention relates to an improved blow tube for use with a core-forming blow plate of the type utilized for making foundry cores of sand. The sand is blown under pressure through a material-dispensing passage in a blow plate assembly and through a blow tube into a cavity in a core box. The sand cores formed in the core box are utilized in the casting of metal in foundries. Such cores take various different configurations and sizes. Consequently, the cavities which form the cores are of different volumes and configurations which in turn requires various different configurations of blow tubes in terms of diameter, length and outlet or discharge opening into the core box. Therefore, it has been necessary to stock various different blow tubes having different configurations to satisfy different core making situations.

(2) Description of the Prior Art

Typically, the prior art blow tubes are fabricated from metal sleeves, which sometimes include cooling chambers, or are fabricated of a plastic material; however, the prior art blow tubes when finished and ready for use are of a fixed length and are specially configured at one end for attachment to the blow plate assembly.

SUMMARY OF INVENTION

The subject invention relates to a finished blow tube for use in a core-forming blow plate assembly with the blow tube comprising an elongated tube having a body portion and a tip portion and attachment means disposed on the body portion to attach the blow tube to the blow plate assembly for positioning the tip portion of the blow tube at any one of various different distances from the blow plate assembly.

Additionally, there are other perfecting aspects to the invention, such as that the blow tube may be cut to different lengths in either the body or tip portions and/or that the tip portion includes annular sealing ribs.

PRIOR ART STATEMENT

A blow tube assembly fabricated of metal and defining cooling passages is shown in U.S. Pat. No. 3,903,952, granted Sept. 9, 1975 to Robert E. Bego et al. The blow tube assembly disclosed in this patent has a specially configured end which inserts into a recess in the blow plate assembly and is retained therein by threaded fasteners which thread into the blow plate assembly. A blow tube made of a plastic material but also including a specially configured end for attachment to the blow plate is shown in U.S. Pat. No. 3,460,607, granted Aug. 12, 1969 to R. L. Olson. The problem with these blow tube assemblies, as alluded to above, is that they are of a fixed length and are suitable for use only in specific situations thereby requiring different blow tubes of different lengths for different situations. The subject invention overcomes such a deficiency by employing a blow tube having attachment means disposed along the tubular body whereby the blow tube may be attached to the blow plate assembly whereby the length or the distance it projects from the blow plate assembly may be adjusted. Said another way, a blow tube constructed in accordance with the subject invention may be utilized in various different lengths. The U.S. Pat. No. 3,104,432, granted Sept. 24, 1973 to E. F. Peterson discloses a blow tube wherein a plastic inner liner is disposed within an outer metal shell and is secured to the metal shell by grooves, threads or the like, however, the blow tube in its finished form is not capable of being utilized in various different lengths as is the subject invention.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
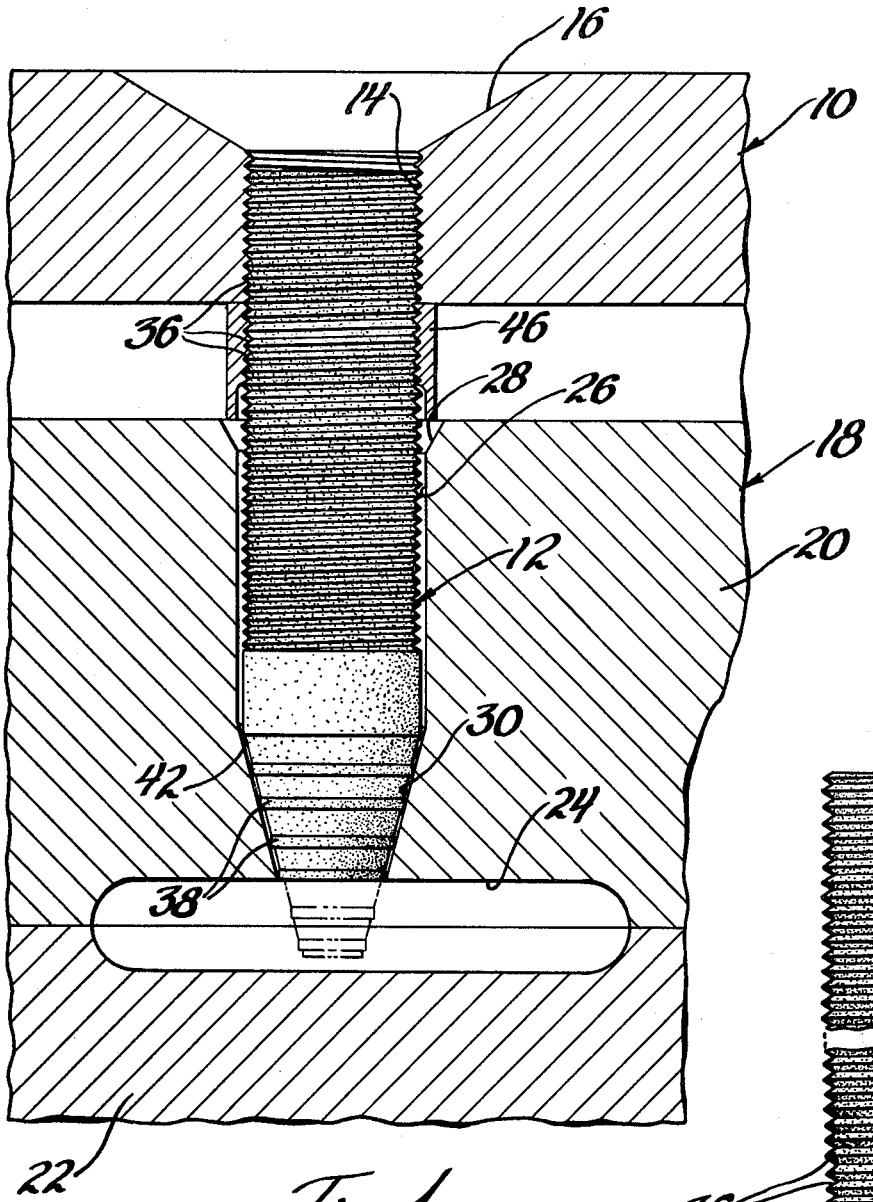
FIG. 1 is a fragmentary cross-sectional view of a blow plate assembly and a blow tube constructed in accordance with the instant invention shown in operative association with a core box.

A blow plate and blow tube assembly is shown in FIG. 1 with the blow plate generally indicated at 10 and the blow tube generally indicated at 12.

The blow plate 10 may be one of various configurations well-known in the prior art and includes a discharge passage 14 which has a flared entrance 16. As is well-known in the art, core-forming sand is guided by the flared portion 16 into the passage 14.

The blow tube 12 is shown in communicative engagement with a core box generally indicated at 18. The core box 18 comprises the two components 20 and 22 which form a sand core cavity 24. The sand core cavity 24 is of a configuration desired for the sand core which will ultimately be utilized in the casting of metal in a foundry. The two components 20 and 22 of the core box separate from one another to remove the finished sand core formed in the cavity 24. The member or component 20 of the core box 18 has a blow tube receiving passage 26 which is flared at its upper end 28 and includes a conical seat 30. The conical seat 30 communicates with the cavity 24 in the core box.

As is well-known in core-making practice, the core box 18 is placed in position and then the blow tube assembly and core box are moved relative to one another together so that the blow tube 12 is inserted into the passage 26 of the core box to the position illustrated in FIG. 1. After the cavity 24 has been filled with sand, the core box and blow plate assembly are separated to withdraw the blow tube 12 from the core box. Because the cavity 24 forming the sand core may be disposed at various different distances from the blow plate assembly when the blow plate assembly and the core box are positioned relative to one another for inserting the sand into the core box, various different lengths of blow tubes may be necessary depending upon the configuration of the cavity 24 and the core box 18.

Figure 2:
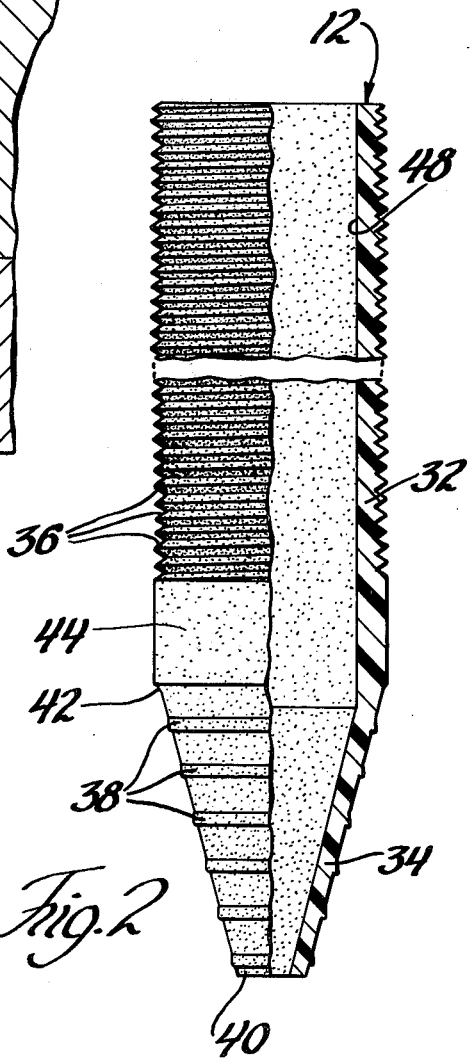
FIG. 2 is a fragmentary cross-sectional view of a blow tube constructed in accordance with the subject invention.

The blow tube 12 as illustrated in FIGS. 1 and 2 includes a body portion 32 and a tip portion 34 for directing the sand material from the blow plate 10 into the cavity 24 of the core box 18. Attachment means comprising the screw threads 36 are disposed on the body portion 32 to attach the blow tube 12 to the blow plate assembly 10 for positioning the tip portion 34 at any one of various distances from the blow plate assembly 10. The passage 14 in the blow plate assembly 10 has female threads therein and the male threads 36 on the blow tube threadedly engage the female threaded portion of the passage 14. The male threads 36 on the body portion 32 of the blow tube extend exteriorly of the blow plate assembly 10. The male threads 36 define attachment means disposed axially along the body portion 32 of the blow tube 12 for engaging attachment to the blow plate assembly 10 at any one of various positions axially along the body portion 32. In other words, the blow tube 12 may be threaded or screwed into engagement with the blow plate assembly 10 until the tip portion 34 is disposed the desired distance from the blow plate assembly 10 to be properly positioned for coacting engagement with the core box 18. Additionally, the body portion 32 and the tip portion 34 are defined by an integral member made of a material which may be cut or severed with a cutting instrument whereby the body portion 32 may be severed to any one of various lengths. In this manner, a blow tube of one diameter and length may be fabricated but may be cut along the threaded body portion to the desired length and threaded into a blow plate assembly to extend from the blow plate assembly the desired length. This overcomes the problem of keeping an inventory of various blow tubes of different lengths to accommodate various different situations. The blow tube 12 is made of a plastic material, such as a urethane elastomer, which may be cut or severed by a sharp instrument such as a knife, or the like.

The tip portion 34 includes a plurality of spaced ribs 38 extending annularly about the exterior surface thereof. The tip portion 34 is defined by a cone having a small diameter tip 40, as illustrated in FIG. 2, and a large diameter base 42. Additionally, the wall thickness of the tip portion 34 increases from the tip 40 to the base 42.

The tip portion 34, like the body portion 32, may be cut or severed so that the tip portion 34 is any one of various lengths having various outlet diameters or orifices. Such is illustrated in FIG. 1 wherein a length of the tip portion 34 which has been severed is illustrated in phantom. The annular ribs 38 define seals which coact with the seating surface 30 in the core box and the tip portion 34 is preferably severed adjacent one of the ribs 30. The thickness of the wall in the tip portion 34 increases from the tip 40 to the base 42 to establish a relationship between the length or amount of tip portion severed and the increase in the resulting orifice or outlet of the tip portion. More specifically, the angled surface of the seat 30 in a core box is generally at a standard angle and by establishing the angle of the interior wall surface of the tip portion, a two-to-one ratio may be set up whereby, for example, when one-eighth of an inch in axial length of the tip portion 34 is severed, the orifice size increases by one-sixteenth of an inch in diameter.

The tube 12 also includes a shoulder or sleeve portion 44 displayed between the threaded body portion 32 and the tip portion 34. The shoulder portion 44 presents a smooth annular outer surface extending axially between the base 42 of the tip portion and the threaded body portion 32.

As illustrated in FIG. 1, when the blow tube is in operative engagement with the core box 18, a space or gap exists between the blow plate assembly 10 and the core box 18. A threaded nut 46 threadedly engages the threads 36 on the body portion 32 for disposition between the blow plate assembly 10 and the core box 18. Specifically, the nut 46 contacts the blow plate assembly 10 and the core box 18. The nut 46 serves as a means for maintaining the axial position of the blow tube 12 when it is threaded into the blow tube assembly and additionally prevents the plastic blow tube from ballooning under pressure in the gap between the blow plate assembly 10 and the core box 18.

As will be appreciated, the threaded engagement of the blow tube 12 with the threaded passage 14 in the blow plate assembly provides a very effective seal between the blow tube and the blow plate assembly. In fact the pressures created in the blow tube as sand is passing therethrough forces the blow tube into engagement with the blow plate assembly, thus, increasing the seal through the plurality of threads.

The interior surface 48 of the blow tube 12 is smooth to facilitate the flow of sand. As will be appreciated, once the blow tube 12 is eroded by the passage of sufficient sand therethrough it is easily replaced with another like blow tube by merely unthreading or unscrewing the blow tube 12 from the blow plate assembly 10 and, if need be, severing a new blow tube to the proper length in the threaded body portion 32 and the tip portion 34 and threading same into engagement with the blow plate assembly.

It will also be appreciated that since the blow tube 12 is made of plastic or flexible material, as the blow plate assembly 10 and the core box 18 are moved into position to insert the blow tube 12 into the core box 18, the tip portion 34 engages the flared entrance 28 to the passage 26 in the core box to guide the blow tube into the core box as the blow tube may shift laterally of its longitudinal axis. Thus, the blow tube assembly of the subject invention greatly reduces the alignment problem with the fixed or rigid blow tubes known in the prior art.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A finished blow tube for use in a core-forming blow plate assembly and comprising; an elongated tube having a body portion and a tip portion defined by an integral member, attachment means disposed on said body portion to attach said blow tube to the blow plate assembly for positioning said tip portion at any one of various distances from the blow plate assembly, said tip portion being defined by a cone having a small diameter tip and a large diameter base, said integral member including a shoulder portion disposed between said body portion and said base of said tip portion, said attachment means comprising threads disposed along said body portion from the end thereof to said shoulder portion, said body portion having an inner diameter which remains constant from the end thereof and along the threaded portion to said tip portion where the diameter decreases to the tip of said tip portion, said integral member being made of a plastic material and being flexible along its length.

2. A blow tube as set forth in claim 1 wherein said integral member is made of a material which may be cut whereby said body portion may be severed to any one of various lengths.

3. A blow tube as set forth in claim 1 wherein said tip portion includes a plurality of spaced ribs extending annularly about the exterior surface thereof.

4. A blow tube as set forth in claim 1 wherein said tip portion is defined by a cone having a wall thickness which increases from said tip to said base.

5. A blow tube as set forth in claim 1 including a threaded nut threadedly engaging said threads on said body portion for disposition between the blow plate assembly and a core box which the blow tube engages.

* * * * *